US005265800A

United States Patent [19]

Ziecker et al.

[11] Patent Number: 5,265,800

[45] Date of Patent: Nov. 30, 1993

[54] ADHESIVE SPRAY GUN WITH ADJUSTABLE MODULE AND METHOD OF ASSEMBLING

[75] Inventors: Roger A. Ziecker; George E. Boccagno, both of Lawrenceville, Ga.

[73] Assignee: Nordson Corporation, Westlake, Ohio

[21] Appl. No.: 8,509

[22] Filed: Jan. 25, 1993

[51] Int. Cl.[5] ..... B05B 15/08

[52] U.S. Cl. ..... 239/1; 239/536; 239/566; 239/587.1; 239/600; 239/DIG. 4; 239/DIG. 9; 118/315; 285/131

[58] Field of Search ..... 239/1, 536, 587.1, 600, 239/DIG. 4, DIG. 9, 135, 550, 551, 566, 568; 222/181, 485; 118/315, 323; 285/131

[56] References Cited

U.S. PATENT DOCUMENTS

| | | | |
|---|---|---|---|
| Re. 27,865 | 1/1974 | Baker et al. . | |
| Re. 33,481 | 12/1990 | Ziecker et al. . | |
| 2,663,229 | 12/1953 | Krogel | 239/566 |
| 2,950,737 | 8/1960 | Hendrix | 222/485 X |
| 2,958,547 | 11/1960 | Batts et al. | 285/131 X |
| 3,570,725 | 3/1971 | Baker et al. | 239/551 X |
| 3,880,358 | 4/1975 | Scharing | 239/551 |
| 4,687,137 | 8/1987 | Boger et al. | 239/566 X |
| 4,785,996 | 11/1988 | Ziecker et al. | 239/600 X |
| 4,815,660 | 3/1989 | Boger . | |
| 5,045,154 | 9/1991 | Baluha | 239/566 X |
| 5,094,398 | 3/1992 | Jeter et al. . | |

FOREIGN PATENT DOCUMENTS

| | | | |
|---|---|---|---|
| 13399 | of 1912 | United Kingdom | 239/587.6 |

*Primary Examiner*—Andres Kashnikow
*Assistant Examiner*—William Grant

[57] ABSTRACT

Apparatus and methods for spraying an adhesive onto a moving surface with a plurality of gun modules which are attached to a transition plate which in turn is secured to adhesive and air service manifolds. The gun modules are secured to movable plates which can be connected to the transition plate in a manner that enables the gun modules to be individually shifted laterally with respect to the transition plate so that the location at which the adhesive is sprayed onto the moving surface is shifted.

23 Claims, 4 Drawing Sheets

ADHESIVE SPRAY GUN WITH ADJUSTABLE MODULE AND METHOD OF ASSEMBLING

FIELD OF THE INVENTION

This invention relates to the field of adhesive spray guns, and more particularly, to an adhesive spray gun device including one or more gun modules which are adjustably secured via a transition plate having a supply line which receives operating from a fixed service manifold and supply line a molten adhesive fluid, for example, and which have range of lateral adjustment so that the adhesive s from the gun modules can be quickly and easily for different applications.

BACKGROUND OF THE INVENTION

Equipment for applying viscous liquids, such as molten adhesives, and especially equipment as that used to apply beads, ribbons or unitary deposits of the extruded adhesive in a desired under highspeed production conditions, is co for applying molten adhesives to materials such as flat sheets of paper or cardboard pac nonwoven woven fibrous material and polyurethane substrates in articles such as disposable diapers and in other sealing applications for a variety of products.

One particular type of adhesive generally termed "hot melt" is often used where there is a need for very short set up time between the a cation of the adhesive and the bonding together of the parts being adhered to each other. Typical hot melt adhesives, such as thermoplastic adhesives, are relatively viscous and are pumped through the nozzle of a spray gun module for application to the surface being sprayed in the form of a continuous bead or as intermittent unitary deposits.

In many high-speed packaging applications, the plurality of continuous beads or intermittent unitary deposits of molten adhesive are simultaneously applied to moving sheets of material through a number of spray gun modules, as discussed in U.S. Pat. No. Re. 27,865 assigned to Nordson Corp., the assignee of the present invention, which patent is incorporated in its entirety herein.

A principal disadvantage of this type of equipment has been the time consuming setup and adjustment procedure required at periodic intervals. When the number of gun modules and the lateral spacing between the beads of adhesive require changing or repositioning for different applications, the individual spray gun modules have to be removed and replaced on the fixed service manifold which receives the supply lines for a molten adhesive fluid and the operating air, as in the case of the U.S. Pat. No. Re. 27,865. This procedure is quite time consuming and requires the interruption of the continuous production facility at frequent intervals. Also, only the angular position of the individual modules could be adjusted in the U.S. Pat. No. Re. 27,865 and each adjustment was independent of the adjustment of an adjacent module. Therefore, the setup and accurate alignment of the modules was still a time consuming procedure. Moreover, repositioning the modules by angular adjustment, can affect the spray pattern of the adhesive. For example, when the swirl spray modules are aligned with respect to the surface being sprayed at an angle other than ninety degrees, the swirl pattern changes from circular to oval.

OBJECTS AND SUMMARY OF THE INVENTION

It is an object of the present invention to attach one or more spray gun modules having a range of adjustment to a fixed service manifold so that the spray can be quickly and easily aligned for different applications to obviate the problems and limitations of the prior art systems.

It is a further object of the present invention to attach one or more spray gun modules having a range of lateral adjustment via a transition plate to a fixed service manifold so that the number and/or position of spray gun modules can be quickly and easily changed and aligned with respect to each other for different applications.

Yet another object is to attach one or more spray gun modules to a transition plate which itself is attachable to a fixed service manifold so that the spray gun modules can be individually aligned and securely fastened to prevent misalignment from the desired position.

In accordance with the invention, there is provided an apparatus for spraying an adhesive onto a moving surface comprising a service manifold having an adhesive passageway. A transition plate is attachable to the service manifold and has adhesive and air passageways. The adhesive passageway of the transition plate is in communication with the adhesive passageway in the service manifold. At least one, and typically a plurality of spray gun modules each with an adhesive passageway and an air passageway for spraying the adhesive is attached to the transition plate whereby the adhesive and air passageways of the gun module are in communication with the adhesive and air passageways of the transition plate. Means are provided for adjusting the lateral position of the gun modules relative to the transition plate while the transition plate and the gun modules are in an assembled condition whereby the location at which the adhesive is sprayed onto the moving surface is shifted.

The means for adjusting comprises a slidable mounting plate with an adhesive passageway and an air passageway which is securely connected to each spray gun module and which is adjustably mounted to the transition plate whereby each gun module can be laterally adjusted relative to the transition plate while adhesive and air passageways of the transition plate remain in communication with the adhesive and air passageways of the mounting plate. The adhesive and air passageways of the transition plate each have a slot shaped opening with bounded ends to form inlet sections in flow communication with the adhesive and air passageways of the mounting plate. Also, seal means in a slot shaped opening with bounded ends forms a fluid or air tight seal between the adhesive and air passageways of the transition plate and the adhesive and air passageways of the mounting plate irrespective of the lateral position of the molten adhesive and air passageways of the transition plate with respect to the molten adhesive and air passageways of the mounting plate. The seal means comprise elastomeric O-rings which fit in the slot shaped opening about the inlet section and which are compressed between the transition plate and the mounting plate.

Means to securely mount the mounting plate on the transition plate includes a wedge shaped element seated in a groove at the top end of mounting plate. The wedge shaped element is pushed downwards against the mounting plate to press together the transition plate and the mounting plate so that the elastomeric O-rings are compressed therebetween. A set screw is threaded within a threaded bore through the transition plate to engage the wedge shaped element and push the mounting plate downwards against the transition plate. In addition, the slidable mounting plate forms a dovetail joint at its bottom end with the transition plate whereby the mounting plate is securely affixed to the transition plate.

In accordance with the invention a manifold with an air passageway therethrough is securely mated against the mounting plate whereby an air passageway therethrough is in communication with an air passageway in the mounting plate which in turn is in communication with a nozzle attachment on the spray gun module. A seal in a slot shaped opening with bounded ends forms an air tight seal between the air passageway of the manifold and the air passageway of the mounting plate irrespective of the relative position of the air passageway of the manifold to the air passageway of the mounting plate.

Further in accordance with the invention, a method of assembling an apparatus for spraying an adhesive onto a moving surface comprises the following steps. A service manifold with an adhesive passageway is attached to a transition plate having adhesive and pressurized air passageways so that the adhesive passageway of the transition plate is in communication with the adhesive passageway in the service manifold. At least one, and preferably a plurality of gun modules are each attached to the transition plate whereby adhesive and pressurized air passageways in the gun module are in communication with adhesive and pressurized air passageways in the transition plate. The lateral position of the gun module can be adjusted relative to the transition plate while the gun and transition plates are in an assembled condition.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1:
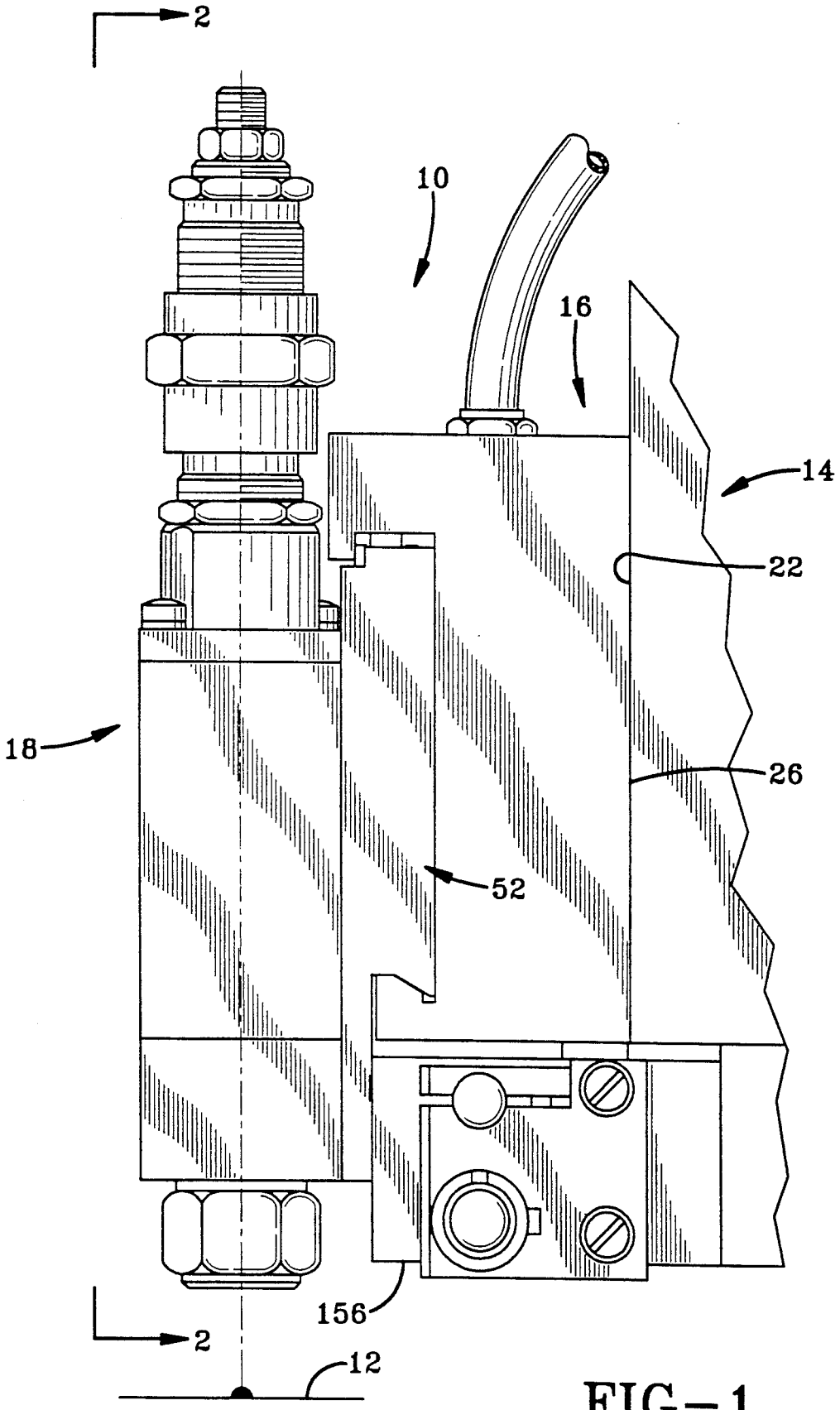
FIG. 1 is a side view of a spray gun module attached to service manifold through an intermediate transition plate in accordance with the invention.
Figure 2:
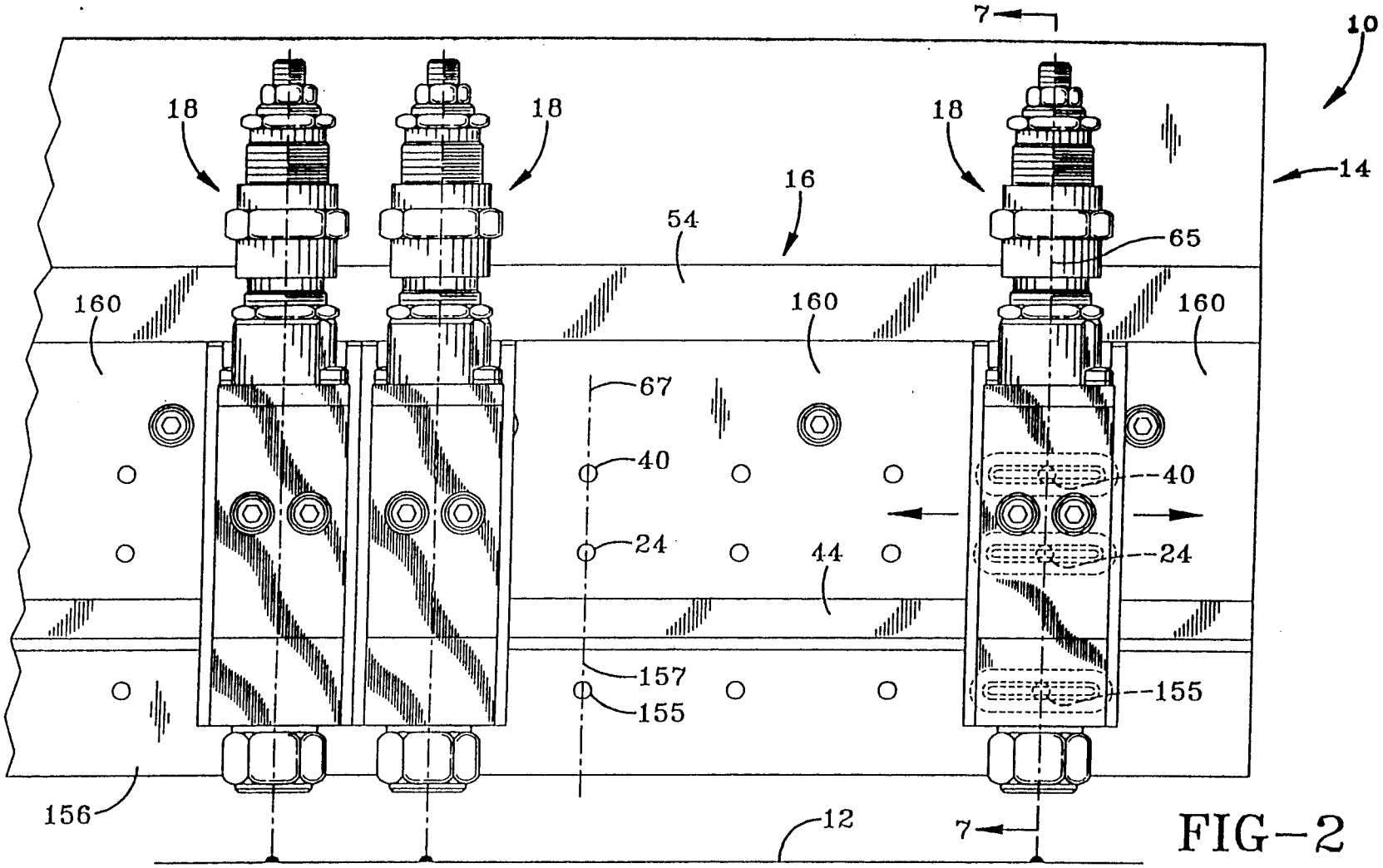
FIG. 2 is a view taken along line 2—2 of FIG. 1 illustrating spaced spray gun modules attached to the transition plate.
Figure 7:
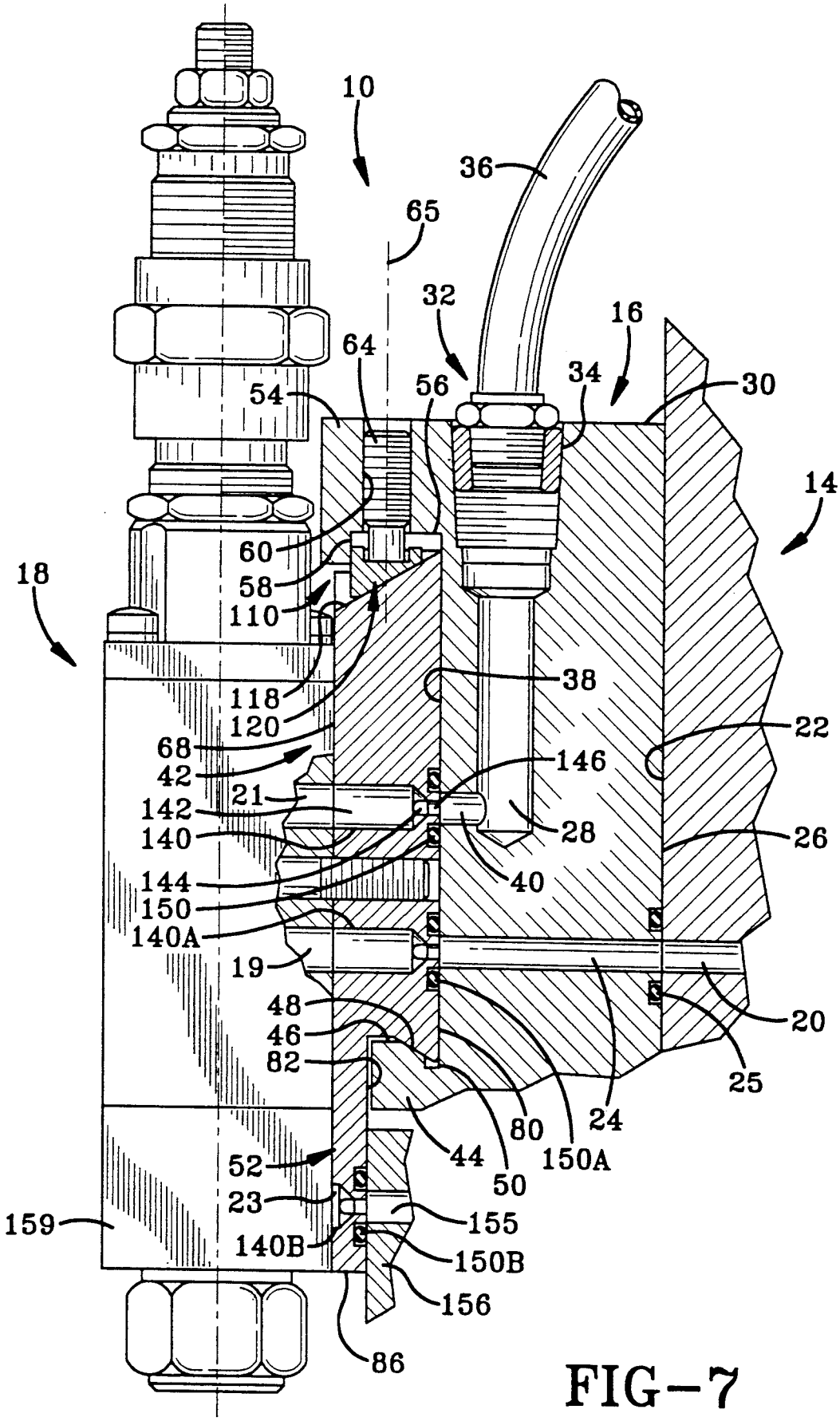
FIG. 7 is a side view, partly in cross section, of the spray gun module attached to service manifold through an intermediate, removable transition plate, as illustrated in FIG. 1.

Referring to the drawings, FIGS. 1, 2 and 7 show an adhesive spray apparatus 10 embodying the invention and adapted for use in connection with equipment for delivering hot-melt type adhesive to a plurality of locations on a moving surface 12. The apparatus 10 comprises a service block manifold 14, an intermediate, removable transition plate 16 securely connected to the service block manifold 14 and one or more spray gun modules 18 each adjustably connected to transition plate 16. The spray gun modules 18 have adhesive and air passage openings 19, 21 and 23 and are arranged to simultaneously extrude a hot-melt adhesive at a plurality of locations on a moving surface 12.

The service block manifold 14 has a passageway 20 therethrough which exits at a flat front surface 22 of manifold 14 to form a molten adhesive supply passage for delivering molten adhesive to transition plate 16 and spray gun modules 18, as discussed in more detail below. The intermediate, removable transition plate 16, as illustrated in FIGS. 1 & 7, has a molten adhesive passageway 24 therethrough and a flat rear surface 26 which mates against service block manifold front surface to provide proper registry between passageways 20 and 24. A seal 25, such as an elastomeric O-ring, can be disposed about the inlet opening of passageway 24 to insure that the hot melt does not leak between the mated surfaces 22 and 26. Transition plate 16 also has an air passageway 28 which is drilled in from an upper surface and has an air fitting 32 which is threadably received within an inlet opening 34 of passageway 28 and is connected by a hose 36 to a source of pressurized air (not shown). The transition plate 16 has a flat front face 38 and an air passageway 40 extending between the flat front face and the vertically extending air passageway 28 to direct operating air into spray gun modules 18, as discussed below. While, the transition plate is illustrated with an air passageway 28 being connected directly to an external source of pressurized air, it is also within the terms of the invention to provide an air passageway through the transition plate which mates with an air supply passage through service block manifold 14 which opens to flat front surface 22, in a similar manner to that of the molten adhesive supply passage 20. Further, while the transition plate is illustrated as being a separate component, it is also within the terms of the invention to construct a transition plate integrally with a service block manifold.

A principle feature of this invention is the construction of a means 42 for adjusting the lateral position of gun modules 18, without angular adjustment thereof, relative to the transition plate 16 while the transition plate and the gun modules are in an assembled condition. Adjustment means 42 includes a base projection 44 that extends both outward from the front surface 38 of transition plate 16 and transversely across the width of front surface 38. Base projection 44 has a o flat upper surface 46 which extends substantially perpendicular to front surface 38 and an inclined surface 48 which intersects the upper surface 46 and projects downward to intersect front surface 38 to form a generally triangular recess. A groove 50 is provided at the intersection of the inclined surface 48 and the front surface 38 to allow for the proper mating of a slidable mounting plate 52. Means 42 also includes a top projection 54 that extends both outward from and transversely across the width of front surface 38 of transition plate 16. Top projection 54 has a rectangular groove 56 which extends longitudinally across the width of transition plate 16 and opens downwardly towards the base projection 44. A rearward facing surface 58 of groove 56 extends parallel to and in opposed facing relation to front surface 38 of transition plate 16. A threaded bore 60 extends between the upper surface 62 of top projection 54 and groove 56. The centerline 65 through the threaded bore 60 is aligned with a vertical centerlines 67 through the spaced passageways 24 and 40. The threaded bores 60 spaced across the transition plate receive a set screw 64 having a non-threaded engagement end to secure a correspondingly positioned mounting plate 52, as discussed below.

Means 42 for adjusting the lateral position of the gun modules relative to the transition plate includes a slidable mounting plate 52, as illustrated in FIGS. 3, 4, 5 and 7, having a front 66 with a generally rectangular, flat front surface 68, oppositely disposed sides 70 and 72 with substantially flat, parallel side surfaces 74 and 76, respectively, and a rear 78 having stepped, parallel, upper and lower, substantially rectangular rear surfaces 80 and 82, respectively. Mounting plate 52 also has a bottom end 84 having a bottom surface 86 extending between the front surface 68 and lower rear surface 82 and a top end 88 extending between the front surface 68 and the upper rear surface 80, as discussed in more detail below.

An important aspect of the invention is the dovetail connection between the mounting plate 52 and the transition plate 16. The intersecting surface between upper and lower surfaces 80 and 82 is constructed of an upstanding surface 90 which projects substantially perpendicularly outward from the lower rear surface 82 and is slightly wider than the flat upper surface 46 of the transition plate's base projection 44, as seen in FIG. 7. A flat inclined surface 92 projects downward between surface 90 and rear upper surface 80 in the shape of a generally triangular recess which forms a dovetail joint with the triangular recess of the base projection 44, as discussed in more detail below.

The top end 88 of the mounting plate 52 has two spaced apart, narrow end projections 94 and 96 at either end with flat, rear upper surfaces 98 and 100, respectively, which intersect the upper rear surface 80 and flat front upper surfaces 102 and 104, respectively, which are stepped below the rear upper surfaces 98 and 100, respectively. Projections 94 and 96, also intersect the front surface 68 and upstanding, flat parallel disposed, intersecting surfaces 106 and 108 which are perpendicular to and extend between the rear upper surfaces 98 and 100 and the front upper surfaces 102 and 104, respectively. The length of rear upper surfaces 98 and 100 is slightly less than the distance between front surface 38 and rearward facing surface 58 of groove 56 so that when the mounting plate 52 is assembled in the transition plate 16, as illustrated in FIG. 7, the mounting plate 52 can slide back and forth with its upper rear surface 80 mated against flat face 22 of transition plate 16. Further, when the mounting plate 52 is assembled in the plate 16, the upstanding walls 106 and 108 engage rearward facing surface 58 of groove 56 to entrap the mounting plate 52 and prevent it from falling away from the front face 22 of transition plate 16.

Figures 3, 4, 5, 6:
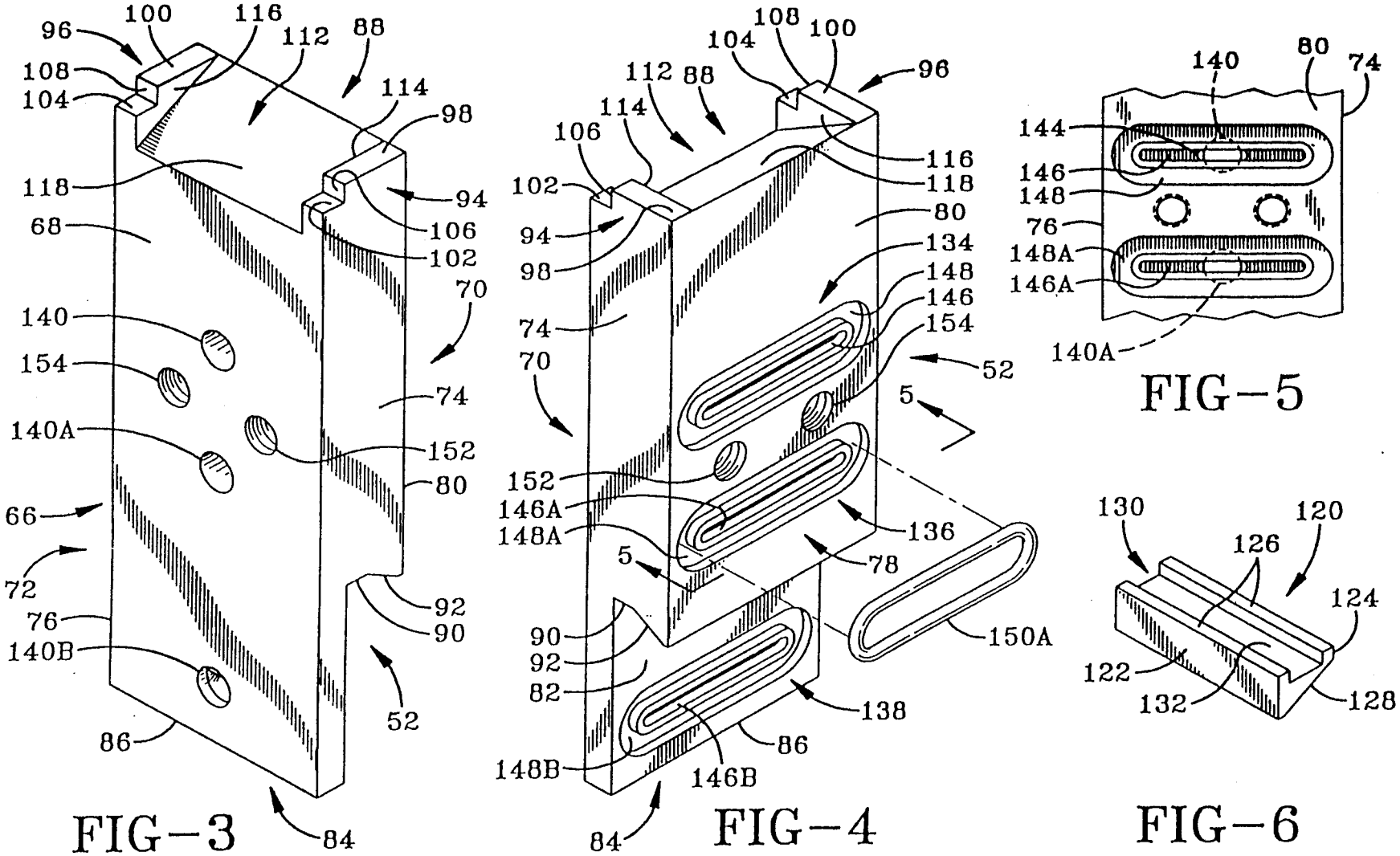
FIG. 3 is a front perspective view of a mounting plate for attaching the spray gun module to the transition plate.
FIG. 4 is a rear perspective view of the mounting plate illustrated in FIG. 3 for attaching the spray gun module to the transition plate.
FIG. 5 is a view taken along line 5—5 of FIG. 4 illustrating seals in a slot shaped opening about adhesive and air passageways.
FIG. 6 is a perspective view of a wedge keeper to secure the mounting plate to the removable transition plate.

The adjustment means 42 for adjusting the lateral position of the gun modules 18 relative to the removable transition plate 16, while the transition plate and the gun module are in an assembled condition, includes a means 110 to securely mount the mounting plate 52 in the plate 16. Means 110 includes the construction of the top end 88 of plate 52 wherein a wide groove 112 between the inner side walls 114 and 116 of end projections 94 and 96, respectively, has an inclined, flat surface 118 which extends upwards from the front surface 68 to the upper rear surface 80. A wedge shaped element 120, as illustrated in FIGS. 6 and 7, is disposed in the groove 112 and has a front flat surface 122, a parallel rear flat surface 124, a top surface 126, and a bottom inclined surface 128 extending upwards from the front surface 122 to the rear surface 124. A rectangular groove 130 is formed in the upper surface 126. Wedge 120 is slightly less in length than the width of groove 112 so that the wedge 120, when assembled in groove 130, is seated between surfaces 114 and 116. The angle between the front surface 122 and the bottom inclined surface 128 is selected so that the surface 128 mates with the inclined surface 118 and the flat bottom surface 132 of groove 130 is perpendicular to centerline 65 through threaded bore 60.

Another important aspect of the invention is the seal means 134 and 136 which form fluid tight seals between molten adhesive and air passageways 40 and 24 of transition plate 16 and the molten adhesive and air passageways 140 and 140A of mounting plate 52. An additional source of pressurized air from a manifold 156 can deliver pressurized air through a passageway 155. In this case, as discussed in more detail below, an additional passageway 140B of mounting plate 52 includes a seal means 138 to form an air tight seal between air passageway 155 and air passageway 140B of mounting plate 52. Since the passageways 140, 140A and 140B are essentially identical in construction, except possibly for their dimensions, only one passageway is next described.

As illustrated in FIGS. 3, 4, 5 and 7, the passageway 140 has an outlet section 142 formed of a circular, elongated bore with an outlet at the front surface 68 of plate 52. An intermediate section 144, having a slot shape, directly adjoins the outlet section. An elliptical oblong shaped, inlet section 146 directly adjoins the intermediate section 144. The width of inlet section 146 determines the range of distance for lateral adjustment of the movable plate 52 with respect to the attached transition plate 16. Typically, the longer width of the inlet section is between about 0.75 and about 1.25 inches and preferably about 1.00 inches and the narrow width is between about 0.050 and 0.075 inches and preferably about 0.060 inches. A slot shaped opening with bounded ends 148 is cut into the upper and lower rear surfaces 80 and 82, respectively, of the slidable mounting plate 52 to receive a seal 150, 150A, 150B such as an elastomeric O-ring, as illustrated in FIG. 4. The O-rings are pressed into the grooves 148, 148A and 148B and project outward from the upper and lower rearward facing surfaces 80 and 82 to compress against the front surface 38 of mounting plate 30 and form a fluid or air tight seal around the registered passageways.

The spray gun module 18 is securely mounted onto the slidable mounting plate 52 with threaded bolts that are threadably received in two threaded through bores 152 and 154. The illustrated embodiment includes a pressurized air passageway 155 through a manifold 156 which is securely mated against the lower rear surface 82 of the mounting plate 52 and provides pressurized air through passageway 140B to a nozzle attachment 159 on the spray gun module 18, as discussed in U.S. Pat.

No. Re. 33,481 assigned to Nordson Corp., the assignee of the present invention, which patent is incorporated in its entirety herein. A vertical centerline 157 through the circular outlet of passageway 155 is aligned with the centerline 65 through bore 60 and centerline 67 through the circular outlets of passageways 24 and 40. While the preferred embodiment includes the air passageway 140B for delivering air to the nozzle attachment on the gun module 18, it is within the scope of the invention to provide a mounting plate without this passageway.

To assemble and align the adhesive spray apparatus 10, gun modules 18 are secured onto mounting plates 52 by means such as threaded bolts and wedges 120 are seated into grooves 112 with the wedge's groove 132 facing upwards. The mounting plates 52 with the attached gun modules are then placed at one side of transition plate 16 which is already securely attached to the service block manifold 14 so that the inclined surface 92 of mounting plates 52 can be aligned with the inclined surface 48 of the transition plate and the wedge 120 is located within the rectangular groove 56 of the transition plate. At this stage of the assembly, set screw 64 is retracted so that its lower, non-threaded end does not abut against the end projection 94 and prevent lateral movement of the mounting block along the front face 22 of the transition plate. Next, the assembler grasps the spray gun modules and slides them laterally across the front of the removable transition plate 16, as illustrated in FIG. 2, to a desired position. Once the gun modules 18 are located at their approximate desired position relative to the vertically arranged, adhesive and air passageways 40, 24 and 155, set screws 64 can be partially tightened so that it engages the slot 130 of the wedge 120. Note that the vertical centerlines through the outlets of passageways 24, 40 and 155 are aligned with each other and with the centerlines 65 through the threaded bores 60 each containing a set screw 64, as illustrated in FIG. 2. Then, the gun modules can be slid or shifted back and forth with respect to each other, without angular movement, for exact positioning. The extent or range of their lateral movement is limited by the width of the oblong shaped inlet section 146, 146A, 146B. That is, the passageways 24, 40 and 155 must be located within the inner perimeter of seal rings 148, 148A and 148B so that no leakage occurs between the mated front surface 38 of the transition plate 16 and the upper and lower rear surfaces 80 and 82 of the mounting plate 52. The lateral movement of each gun module is mechanically limited by set screw 64 which abuts against the side walls 114 and 116 of the groove 112 formed in the top end 80 of plate 52.

Once the gun modules are positioned, as desired, the set screws are each sufficiently tightened to push the wedge blocks 120 downward which in turn causes the inclined surface 92 of the plates to slide down inclined surface 48 of the transition plate 16 and thereby press together the mating surfaces 38 and 80 of transition plate 16 and plates 52, respectively, so that the O-ring seals 150, 150A, 150B are compressed therebetween to form fluid-tight and air-tight seals around the adhesive and air passageways about which they are located. Since the wedge block 120 engages the majority of the top 88 of the mounting plate 52, the downward force is spread substantially evenly across the dovetail joint between flat inclined surface 92 and the triangular recess of the base projection 44 to securely affix the movable mounting plate 52 to the transition plate 16. After the adhesive spray device 10 is set up and operating, it can be easily readjusted by simply loosening the set screws 64 and laterally sliding one or more of the gun modules to the right or left to change the location at which the spray from each is delivered onto the surface 12.

An important feature of the invention is that the alignment of the centerlines 67, 157 through the outlets of passageways 40, 24 and 155 with the centerline 65 through the threaded bore 60 provides the maximum range of adjustment of plate 52 and transition plate 16 because the passageways 140, 140A, 140B are in flow registration with passageways 40, 24, 155, respectively, for the same distance to either side of the vertical axis 67 and 157.

It is apparent that there has been provided in accordance with this invention apparatus and methods for attaching spray modules to a fixed service manifold so that the number and position of spray gun modules can be quickly and easily changed and laterally aligned with respect to each other. Further, the spray gun modules can be securely fastened to provide fluid tight seals about the air and adhesive passageways and to prevent the spray gun modules from moving out of alignment from a desired position.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

We claim:

1. An apparatus for spraying an adhesive onto a moving surface, comprising:

a service manifold having an adhesive passageway therethrough;

a transition plate secured to said service manifold and having an adhesive and an air passageway with said adhesive passageway in said transition plate being in flow communication with said adhesive passageway in said service manifold;

at least one spray gun module with an adhesive passageway and an air passageway for spraying said adhesive, said at least one gun module being attachable to said transition plate whereby said adhesive and air passageways of said at least one gun module are in flow communication with said adhesive and air passageways of said transition plate; and means for adjusting the lateral position of said at least one gun module relative to said transition plate while said transition plate and said at least one gun module are in an assembled condition whereby the location at which said adhesive is sprayed onto said moving surface is shifted.

2. The apparatus of claim 1 wherein said means for adjusting comprises a slidable mounting plate with an adhesive and an air passageway which is securely connected to said at least one spray gun module, and which is adjustably mounted to said transition plate whereby said gun module can be laterally adjusted relative to said transition plate while said adhesive and air passageways of said transition plate remain in flow communication with said adhesive and air passageways of said mounting plate.

3. The apparatus of claim 2 wherein inlet sections of said adhesive and air passageways of said mounting plate each include a slot shaped opening with bounded ends which is in flow communication with said adhesive and air passageways of said transition plate.

4. The apparatus of claim 3 including seal means in said slot shaped openings with bounded ends shaped for forming a fluid tight seal between said adhesive and air passageways of said transition plate and said adhesive and air passageways of said mounting plate irrespective of the relative position of said adhesive and air passageways of said transition plate to said adhesive and air passageways of said mounting plate.

5. The apparatus of claim 4 wherein said seal means includes an elastomeric O-ring disposed in each of said slot shaped openings which is compressed between said transition plate and said mounting plate.

6. The apparatus of claim 5 wherein said means for adjusting further includes means to securely mount said mounting plate on said transition plate, said means including a wedge shaped element seated in a groove at the top end of said mounting plate, said wedge shaped element being pushed downwards against said mounting plate to press together said transition plate and said mounting plate so that said elastomeric O-rings are compressed therebetween.

7. The apparatus of claim 6 further including a set screw within a threaded bore through said transition plate, said set screw being threaded into said threaded bore to engage said wedge shaped element and push said mounting plate downwards against said transition plate.

8. The apparatus of claim 7 wherein said mounting plate forms a dovetail joint at its bottom end with said transition plate whereby said mounting plate is securely affixed to said transition plate.

9. The apparatus of claim 2 further including a manifold having an air passageway therethrough, said manifold being securely mated against said mounting plate whereby said air passageway of said manifold is in flow communication with a second air passageway through said mounting plate which in turn is in flow communication with a nozzle attachment on said spray gun module.

10. The apparatus of claim 9 including a seal means in a slot shaped opening with bounded ends about an inlet section of said second air passageway of said mounting plate for forming an air tight seal between said air passageway of said manifold and said second air passageway of said mounting plate irrespective of the relative position of said air passageway of said manifold to said second air passageway of said mounting plate.

11. The apparatus of claim 10 wherein said seal means comprises an elastomeric O-ring which is disposed in said slot shaped opening about said inlet section which is compressed between said manifold and said mounting plate.

12. The apparatus of claim 1 including a plurality of gun modules mounted on said transition plate.

13. The apparatus of claim 1 wherein said transition plate is removably attached to said service manifold.

14. A method of assembling an apparatus for spraying an adhesive onto a moving surface, comprising the steps of:

attaching a service manifold to a transition plate said transition plate having an adhesive and a pressurized air passageway therethrough, so that an adhesive passageway through said service manifold is in fluid communication with said adhesive passageway through said transition plate;

attaching at least a first gun module to said transition plate whereby an adhesive and a pressurized air passageway in said gun module are in communication with said adhesive and pressurized air passageways in said transition plate; and adjusting the lateral position of said gun module relative to said transition plate while said gun module and said transition plate are in an assembled condition.

15. The method of claim 14 further including the steps of:

securely connecting said at least one gun module to a slidable mounting plate, said mounting plate including with an adhesive passageway and an air passageway; and adjustably mounting said mounting plate to said transition plate whereby said gun module can be laterally shifted relative to said transition plate while said adhesive and air passageways of said transition plate remain in flow communication with said adhesive and air passageways of said mounting plate.

16. The method of claim 15 further including the step of attaching a plurality of gun modules to said transition plate with mounting plates whereby each of the said gun modules can be laterally adjusted independently of the other of said gun modules relative to said transition plate while said adhesive and air passageways of said transition plate remain in communication with said adhesive and air passageways of said mounting plates.

17. A component assembly for adjustably mounting at least one spray gun module to a service manifold, said component assembly comprising:

a transition plate having an adhesive and an air passageway therethrough and including means for adjoining to said service manifold; and a slidable mounting plate with an adhesive and an air passageway therethrough mounted against said transition plate to enable lateral adjustment relative thereto while said adhesive and air passageways of said transition plate remain in flow communication with said adhesive and air passageways of said mounting plate and including means for adjoining to one of said at least one spray gun module.

18. The component assembly of claim 17 wherein inlet sections of said adhesive and air passageways through said mounting plate each include a slot shaped opening with bounded ends in flow communication with said adhesive and air passageways of said transition plate.

19. The component assembly of claim 18 including seal means in each slot shaped opening for forming a fluid tight seal between said adhesive and air passageways of said transition plate and said adhesive and air passageways of said mounting plate irrespective of the relative position of said adhesive and air passageways of said transition plate to said adhesive and air passageways of said mounting plate.

20. The component of assembly of claim 19 wherein said seal means includes an elastomeric O-ring disposed in each slot shaped opening which is compressed between said transition plate and said mounting plate.

21. The component assembly of claim 20 further including a wedge shaped element seated in a groove at the top end of said mounting plate, said wedge shaped element being pushed downwards against said mounting plate to press together said transition plate and said mounting plate so that each elastomeric O-ring is compressed therebetween.

22. The component assembly of claim 21 further including a set screw within a threaded bore through said transition plate, said set screw being threaded into said threaded bore to engage said wedge shaped element and push said mounting plate downwards and towards said transition plate.

23. The component assembly of claim 22 wherein said mounting plate forms a dovetail joint at its bottom end with said transition plate whereby said mounting plate is securely affixed to said transition plate.

* * * * *

UNITED STATES PATENT AND TRADEMARK OFFICE

CERTIFICATE OF CORRECTION

PATENT NO. : 5,265,800
DATED : Nov. 30, 1993
INVENTOR(S) : Ziecker et al.

It is certified that error appears in the above-indentified patent and that said Letters Patent is hereby corrected as shown below:

In column 1, line 12, "supply line" appears instead of "supply lines for".

In column 1, line 14, "adhesive s" appears instead of "adhesive sprays".

In column 1, line 15, "easily for" appears instead of "easily aligned for".

In column 1, line 19, "especially equipment" appears instead of "especially such equipment".

In column 1, line 21, "highspeed" appears instead of "high-speed".

In column 1, line 22, "is co for" appears instead of "is commonly used for".

In column 1, line 22, "to materials" appears instead of "to varying materials".

In column 1, line 23, "cardboard pac nonwoven" appears instead of "cardboard used in packaging, non-woven".

In column 1, line 29, "a cation" appears instead of "application".

In column 1, line 58, "U.S. Patent No. Re. 27,865" appears instead of "Re. 27,865".

UNITED STATES PATENT AND TRADEMARK OFFICE

CERTIFICATE OF CORRECTION

PATENT NO. : 5,265,800

DATED : Nov. 30, 1993

INVENTOR(S) : Ziecker et al.

It is certified that error appears in the above-indentified patent and that said Letters Patent is hereby corrected as shown below:

In column 4, line 22, no new paragraph appears at "The intermediate".

In column 4, line 31, "upper surface" appears instead of "upper surface 30"

In column 4, line 59, "has a o flat" appears instead of "has a flat".

In column 10, line 58, "component of assembly of" appears instead of "component assembly of".

Signed and Sealed this

Eleventh Day of October, 1994

Bruce Lehman

*Attest:*

BRUCE LEHMAN

*Attesting Officer*

*Commissioner of Patents and Trademarks*